US005290998A

United States Patent [19]

Couch et al.

[11] Patent Number: 5,290,998

[45] Date of Patent: Mar. 1, 1994

[54] CORDLESS IRON AND ELECTRICALLY HEATED IRONING BOARD COMBINATION

[75] Inventors: Kenneth J. Couch, Devon; David K. Thompson, London, both of United Kingdom

[73] Assignee: Gemini Clothescare Limited of the Rookery, United Kingdom

[21] Appl. No.: 663,895

[22] PCT Filed: Jul. 6, 1989

[86] PCT No.: PCT/GB89/00765

§ 371 Date: Mar. 6, 1991

§ 102(e) Date: Mar. 6, 1991

[87] PCT Pub. No.: WO90/00642

PCT Pub. Date: Jan. 25, 1990

[30] Foreign Application Priority Data

Jul. 6, 1988 [GB] United Kingdom ..... 8816089

[51] Int. Cl.[5] ..... H05B 1/02; D06F 71/29; D06F 79/02; D06F 81/08

[52] U.S. Cl. ..... 219/247; 38/71; 38/104; 38/107; 38/135; 38/142; 219/251; 219/259

[58] Field of Search ..... 219/245-259; 82/82, 75, 135; 38/71, 72, 103, 104, 107, 142

[56] References Cited

U.S. PATENT DOCUMENTS 2,339,495 1/1944 McMann .
3,745,676 7/1973 Dikoff .

FOREIGN PATENT DOCUMENTS 126530 11/1984 European Pat. Off. .
268722 6/1988 European Pat. Off. .
328727 8/1989 European Pat. Off. ..... 38/135
8706411 7/1987 Fed. Rep. of Germany .
618803 2/1949 United Kingdom .
1399827 7/1975 United Kingdom .
2201814 9/1988 United Kingdom .

*Primary Examiner*—Anthony Bartis
*Attorney, Agent, or Firm*—Larson and Taylor

[57] ABSTRACT

An electric iron is provided together with a temperature control module whereby the iron is electrically connectable to the module and is temperature controllable from circuitry therein. The iron is cordless and the control module includes a support platform for the iron. The control module may be part of an ironing board which itself is electrically heatable and may be adapted to form a trousers press. The iron cooperatively interengages the platform in a rest position at a forwardly sloping angle which enhances stability, allows gravity to maintain the iron in interengagement with the platform and enhances convenient removal of the iron from the platform for use. The iron and platform have cooperable electrical connectors which are brought into engagement via a forward pivotal movement of the iron with respect to the platform upon placement of the iron thereon for establishing an electrical connection between a power supply associated with the circuitry of the module and the electric heating element of the iron. The electrical connectors associated with the platform are mechanically and electrically shielded from contact by the user when the iron is removed therefrom for use. The ironing board is heated by electrical heaters controlled by the circuitry of the module.

14 Claims, 7 Drawing Sheets

CORDLESS IRON AND ELECTRICALLY HEATED IRONING BOARD COMBINATION

This invention relates to pressing apparatus including irons of the type for pressing or smoothing clothes, sheets or other articles made from fabric material, such pressing irons and their use being hereinafter referred to as "irons" and "ironing", and also to ironing boards.

It is conventional ironing practice, particularly in the domestic situation, to employ an unheated padded ironing surface, commonly referred to as an ironing board or ironing table, on which the article to be pressed is placed, in combination with a heated hand-held iron The iron is generally self-heated by means of an internal electric heater element controlled to a predeterminable temperature by means of a thermostat and connected to a power socket by means of a flexible cable and plug.

EP-A 0126530 discloses domestic laundry equipment in which an ironing board is heatable by means of an electrical heater element mounted in the board and controlled by a control circuit also mounted in the board, the control circuit including means for electrically connecting thereto an electrically-heated flat iron, whereby temperature control of the flat iron can be effected from the control circuit on the board It is a stated preference that the iron has an electrical resistance heating element supplied from the same power supply as the electrical resistance element of the ironing board, so that control of both the iron and the board can be effected from the same circuit to maintain the required temperatures, preferably different temperatures, by a setting relating to the board temperature.

It is also known to provide a so-called "cordless" iron, in which the cable to the iron is dispensed with and the iron includes electrical contacts by means of which the heating element is energised when the iron is placed on a support which includes pins connected to a power source, whereby the pins are in electrical connection with the contacts and the iron is thereby heated to its operating temperature when correctly positioned on the support. The advantage of this arrangement to the user is that the cable connection is attached only to the support, thereby affording optimum freedom of movement to the user of the iron, unencumbered by the cable However, cordless irons of the above type have attendant disadvantages, in that they need to be replaced frequently on the support for re-energisation of the heating elements. Since each re-energising period is required to be of short duration, typically while a pressed article is removed from the ironing board and replaced by an unpressed article, the rather slow and crude control exercised by a traditional thermostat militates against effective maintenance of the required operating temperature.

This problem can in part be overcome by raising the power rating of the iron, thereby improving the rate of temperature increase. However, this does not cure the fundamental problem of slow response and .hysteresis associated with the thermostat control and in any event a greater risk of contact arcing and consequent erosion is presented, due to the higher currents used, unless a microswitch or other power isolation device is included in the circuitry.

Yet a further disadvantage of existing cordless irons is that they are not sufficiently stable, when in position on the support, to withstand accidental knocks or sudden movement of the support without becoming dislodged.

They are therefore potentially dangerous, particularly when the support is placed in use on a traditional ironing board which may itself be somewhat unstable, particularly to lateral forces.

It is an object of the present invention to provide pressing apparatus, preferably involving a cordless iron, which overcomes the problems referred to above It is a further object to provide an improved arrangement of folding legs for ironing boards.

According to the present invention, we provide pressing apparatus comprising a cordless iron having an electrically-energised heater element, the iron being in combination with a control module for electrical connection of the element to a source of electrical power, in which the iron has a temperature sensor in thermal contact with the sole plate thereof and the apparatus includes control circuitry mounted within the control module for controlling the supply of electrical power to the heater element according to the perceived temperature of the sole plate in relation to the selected temperature.

The use of feedback control from the temperature sensor enables a higher-rated element to be used with a greater degree of sensitivity in the control thereof, compared with thermostatically-controlled arrangements.

Preferably, in apparatus according to the invention, the iron is cordless and the control module comprises a support platform, the element of the iron being in electrical connection with the source of electrical power when the iron is positioned on the platform.

Although temperature setting may be performed by means of a rotatable selector knob connected to a potentiometer, it is preferred that selection is by means of touch-pads or pressure switches and the circuitry is electronic. In particular, power switching is advantageously performed by triacs.

When the iron is in position on the support platform, it is preferably interengaged with the platform at a forwardly-sloping angle. In this position, it is convenient for the user to remove the iron from the platform and furthermore the stability of the iron is enhanced in that the interengagement gives superior resistance to accidental knocks compared with the mere placing of the iron on a support. By "interengagement", accordingly, is meant mechanical cooperation between the iron and the support platform by means of male and female parts thereon. Preferably, the iron is fully interengaged with the support platform in a rest position in which it is connected to a source of electrical power and is locatable in or removable from the rest position via a location/removal position in which the iron is disconnected from the source of electrical power, the iron being pivotable with respect to the support platform between the location/removal and rest positions, gravity thus serving to maintain the iron in stable interengagement in the rest position on the support platform. For example, the iron may be provided at its tail end with a tongue which is interengageable with a recess in the support platform, the mouth of the recess being defined by a slot and the recess being formed with an undercut region to one side to accommodate the tongue as the iron pivots between the location/removal and rest positions. Thus, to position the iron on the platform, the iron is held in an approximately vertical position with the tail downwards and is offered to the platform such that the tongue is received in the slot, preferably on inner side shoulders which define guide means, whereupon the iron may be released or may be allowed to pivot forwardly, for example about a pivot axis between the underside of the tongue and the edge of the slot remote from the undercut region, whereby the tongue performs a corresponding rearward arcuate movement within the undercut region, preferably guided by the guide means, until the upper side of the tongue is in engagement with abutment means to prevent further movement. The abutment means may be integrally formed as an extension of the guide means. The weight of the iron acting downwards thus urges the upper side of the tongue into continuing contact with the abutment means, thereby imparting stability to the iron in the rest position. Additional lateral stability may be provided by forming the sides of the undercut region to accommodate the width of the tongue with only marginal clearance and/or by raised or upstanding formations at the ends of the slot. In the rest position, the iron is stably held in the preferred forwardly sloping attitude at an acute angle to the horizontal, which is a convenient angle for the user to grip the handle of the iron to remove it from the support platform.

To enable the element to be electrically connected to the power source, respective contacts may be provided on the interengaging surfaces of the iron and the support platform, the contacts themselves being in engagement at least when the iron is in the rest position. The electrical contacts comprise live and neutral connections together with an earth connection, and temperature sensor contacts if the control circuitry is mounted in the support platform or control module. Preferably, a secondary earth connection to the iron is included, to remove any accumulated static, the force field of which may otherwise destabilize the control circuitry, before the principal earth connection is made.

Preferably contacts for live and neutral connections on the iron are provided on the upper surface of the tongue and corresponding contacts on the support platform are resiliently mounted within the undercut region, whereby the respective iron and support platform contacts are facing each other immediately before they come into engagement as the iron is allowed to assume the rest position Preferably, mechanical and/or electrical isolation means are provided to prevent the user or an infant from accidentally touching live contacts when the iron is removed from the support platform. Such means may comprise a cut-out switch actuated by the presence of the iron on the support platform, or mechanical shrouds or shutters which may be biassed to cover the live terminals except when the iron is present on the support platform. For example, shutters may be provided within the recess of the support platform to prevent accidental access to the contacts when the iron is not in position. The shutters may be biassed to the closed position and moved, for example by sliding motion, to the open position against the bias by the act of offering the iron to the support platform. One way of achieving this is for the tongue of the iron to include a pin or probe which engages with a shutter-operating mechanism so that the shutters continue to provide protection until the tongue itself effectively blocks access to the contacts. Conveniently, the pin or probe is constituted by the earth connection In a preferred arrangement, however, the support platform contacts are moveably mounted and are biassed towards a retracted position in which they are contained within a housing, preferably that of the support platform itself, the contacts being moveable against the bias by the iron as it is interengaged with the platform to an extended position in which they protrude from the housing to engage the iron contacts, direct access to the contacts being prevented by a portion of the iron itself.

It is also preferred that the iron-support platform combination includes means for preventing current flow across the contacts unless and until the contacts are engaged, thereby to prevent arcing and resultant contact erosion caused by making and breaking the circuit across live contacts. One way of providing such means is to arrange the contacts so that, on location or removal of the iron on or from the support platform, the contacts make or break in a predetermined sequence. This sequence can allow the control circuitry to detect the location or removal of the iron and to control the power flow accordingly, before any arcing can occur. The contacts can be arranged so that the sequence of engagement is: firstly, the earth contacts; secondly, the live and neutral contacts; and thirdly, the temperature sensor contacts, the latter forming part of a switching circuit to control the power to at least the live contact. The presence or absence of the iron is detected by the control circuitry via the temperature sensor contacts so that, on location of the iron in the support platform, the live and neutral contacts are engaged before power is permitted to flow and, on removal of the iron, the power is isolated before the live and neutral contacts are disengaged, the disengagement sequence being the reverse of the engagement sequence.

The electrical contacts or at least the power and temperature sensor contacts are preferably in the form of pads rather than pins, at least in the case of those provided on the tongue of the iron, and may be recessed, flush with or raised relative to the surface of the tongue Particularly when flush or raised, they are thereby to a certain extent self-cleaning and in any event may readily be purposely cleaned if necessary. Furthermore they cannot become bent or otherwise mis-aligned. They also provide a larger contact area for engaging with the corresponding contacts on the support platform, so allowing a positional tolerance for the iron on the support platform.

As already stated, it is preferred that power switching is performed by triacs rather than relays, and power switching can occur only at zero crossing of the mains supply. By way of example, at 50Hz, as in the mains United Kingdom supply, the longest possible switching time is 10 m.sec., and in consequence it is important that the contacts engagement/disengagement sequence should not be completed in less than 10 m.secs. This can be determined by the physical spacing of the contacts and in practice a minimum sequence time of approximately 40 m.secs can be achieved.

As an additional safety feature, power flow to the element may be permitted only if the temperature sensor is in circuit and within the correct range. Abnormal sensor readings due to short or open circuit, or excess temperature, cause the power supply to be isolated Furthermore, a thermal fuse may be provided in the iron that will blow to cause an open circuit condition should the temperature of the iron reach a dangerous level.

The support platform is connected to a power source via a flexible cable which may optionally be retractable into the platform The support platform may be incorporated into an ironing board or may be free-standing, to enable the iron to be used on a table or any other working surface If incorporated into or otherwise associated with an ironing board, the board itself may be heated and the temperature of the board as well as of the iron may be controlled simultaneously by the same circuitry, in the manner envisaged in EP-A 0126530.

An alternative form of control circuitry for such a system uses a common electronic device for simultaneous temperature control of both the iron and the board. Such circuitry may also be used for switching controls, timer and indicator lights. Using such a circuit, the user may make a particular temperature selection, according to the nature of the fabric to be ironed, and, from this single selection, both the iron and the board will be caused to be heated to pre-set and preferably different temperatures. By this means, the use of steam as an aid to achieving a high quality ironed product is rendered unnecessary. Preferably the power rating of the heater element in the iron is greater than that in the board, to facilitate initial heating and subsequent maintenance of the selected temperature.

Conveniently, the control circuitry is activated by means of push-buttons, membrane switches or touch-pads, suitable indications or codes being included to indicate the intended use of allowable temperature selections. Audible or visual indicators may be incorporated to indicate selections made, error states and the like. Additionally a time-delay cutout may be incorporated to isolate the electrical power if the iron is absent from the support platform for longer than a pre-determined time. Furthermore the iron-receiving part of the support platform may be rotatably mounted thereon, for the added convenience of the user.

Optionally, and particularly where the support platform is incorporated in the board as an integral part thereof, the plate which constitutes the ironing surface of the board may cooperate with another plate to exert mutual pressure therebetween, whereby the board may be used as a trousers press. For example, the other plate may underly the ironing plate and may be attached to the legs of the ironing board with the support platform at one end thereof, and the plate which constitutes the ironing surface may be hinged to the underlying plate at or towards one end, whereby they may be parted at the other end for insertion of a pair of trousers to be pressed and closed together to grip, tension and exert pressure on the trousers, at least one of the plates including a heater element, also controlled by the circuitry as aforesaid. Opening and closing of the plates may be controlled by a lever arrangement in which for example the arms of a frame pivotally attached to the underside of the underlying plate towards the end remote from the hinge slidingly cooperate with rollers or other bearing means carried at the sides of the ironing plate, whereby pivotal movement of the arms causes opening or closing action of the plates via a sliding pincer action. The pivoted ends of the arms may be formed to receive and retain the bearing means in the closed position against inadvertent opening. The legs, which support the ironing surface of the board in a substantially horizontal position above ground level during ironing and are foldable for storage, may be further characterised in that they are openable to an intermediate position in which the board is freely standable with the plates substantially vertical, for use in the trousers press mode as more fully explained hereinafter.

The invention also includes, in a further aspect, therefore, pressing apparatus comprising a heatable ironing board adaptable as a trousers press, in which the ironing surface of the board comprises a plate which cooperates with an underlying plate to form a trousers press, the underlying plate being connected to a support system for maintaining the plates above ground level either substantially horizontally disposed for use in the ironing mode or substantially vertically disposed for use in the trousers press mode. In such an arrangement, a lower plate assembly comprises an upper pressing surface and an upper plate assembly comprises an upper ironing surface and a lower pressing surface cooperable with the said upper pressing surface to form a trousers press, at least the upper plate assembly including a heater element and the plate assemblies being hingeably connected together for example at one end and relatively movable between a closed position for pressing or ironing and an open position for insertion or removal of items to be pressed, the lower plate assembly being connected to a support system for maintaining the working surfaces above ground level, either substantially horizontally disposed for use in the ironing mode or substantially vertically disposed for use in the trousers press mode.

Preferably, such a board includes electrical circuitry to pre-heat the element to a desired temperature and to maintain the said temperature Preferably also the assemblies are hingeably connected by a displaceable hinge which permits the pressing surfaces to be moved apart in the pressing mode while remaining substantially mutually parallel, to accommodate different thicknesses of items to be pressed while maintaining even overall pressing pressure thereon.

Such an ironing board preferably includes a support platform for a cordless iron and the control circuitry therefor controls the heating element or elements in the board as well as the iron to independently-programmable temperatures from a common electronic circuit, as described above.

In yet a further aspect, the invention includes pressing apparatus comprising an ironing board including foldable legs to support the ironing platform in use above ground level, in which the legs describe a generally X configuration when open and fold to a closed position with the feet thereof adjacent and at one end region of the board.

Preferably the ironing board has a heatable surface and includes a separate pressure plate hingeably connected to the ironing platform to form a trousers press. Optionally the separate pressure plate may be independently heatable, the control of both heated plates being within the board as already described hereinabove.

The folded closed position may comprise an intermediate position in which the board is free-standing with the ironing platform substantially vertical, for either free-standing storage or, additionally and when a separate pressure plate is included, for use in the trousers press mode, and a fully closed position for storage against a wall or other support.

According to one embodiment of this aspect of the invention, a first leg is pivotably attached to the underside of the ironing platform and is provided with a knee joint between the said attachment point and its pivot axis to the other leg, whereby the knee joint is locked open when the legs are in the open position but is broken to allow the legs to assume the intermediate or fully closed positions, whereby the parts of the said first leg above and below the knee joint fold towards each other so that the foot end of the said first leg pivots towards the foot end of the other leg. The other leg may be slidably as well as pivotally attached to the underside of the ironing platform, to act as a lost motion linkage on opening or closing of the legs and optionally to provide for height adjustment of the board.

Embodiments of the, invention will now be described by way of example, with reference to the accompanying drawings, of which:

Figure 1:
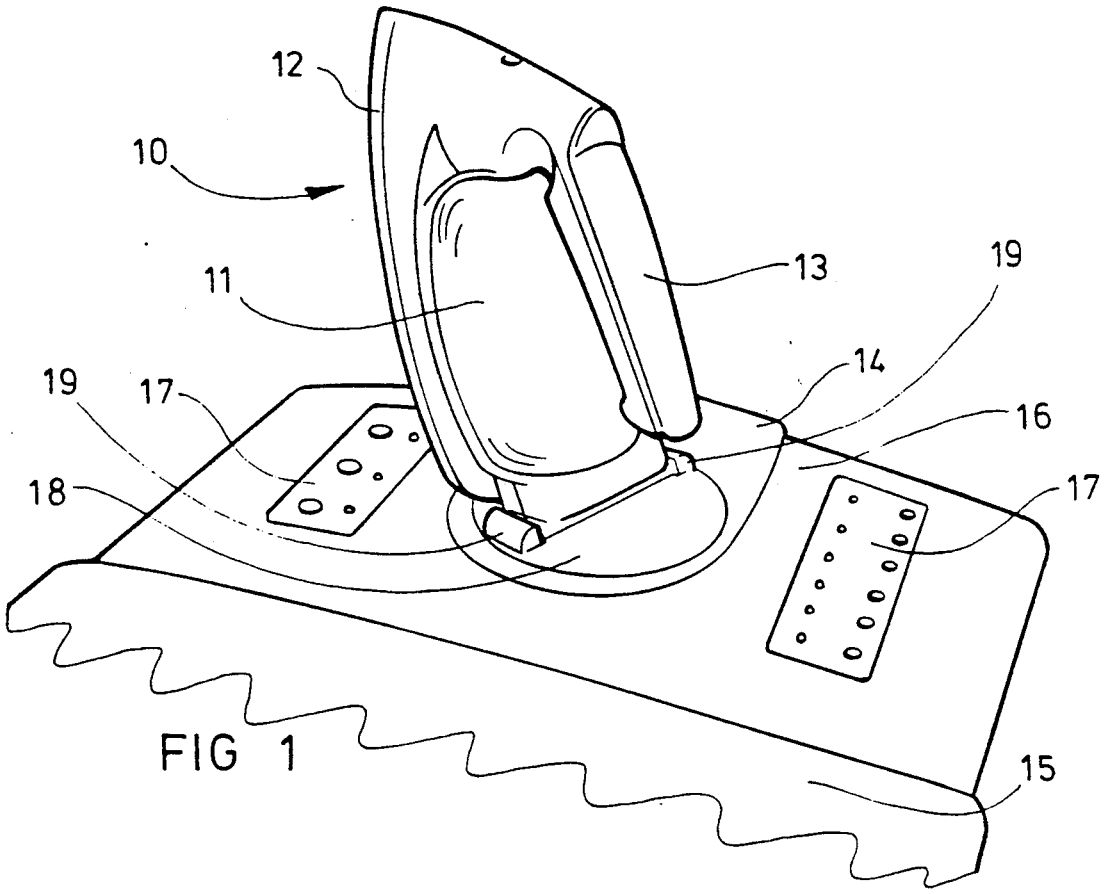
FIG. 1 is a perspective part cut-away view showing an iron in the rest position in a parking dock at one end of an ironing board.

Referring first to FIG. 1, a cordless iron 10 including a body portion 11 in which is carried a heater element and a temperature sensor, a sole plate 12 and a handle 13, is shown engaged in the rest position on a support platform 14 manufactured as an integral part of an ironing board, the heel of the ironing surface of which is shown at 15. The support platform includes a faschia plate 16 having control panels 17 equipped with control buttons and warning lights, and a parking dock comprising a turntable 18. As shown in the rest position and as more fully described with reference to FIGS. 2–4, the iron is stably held within a recess in the turntable and sloping forwardly at an acute angle to the horizontal, the mouth of the recess being defined by a slot the ends of which have upstanding formations 19 for imparting additional lateral stability to the iron.

Figure 2:
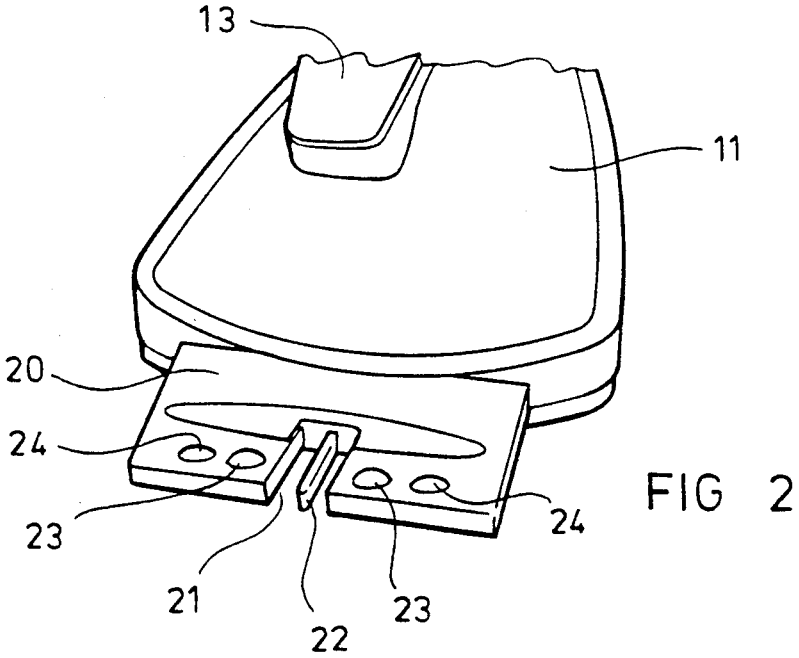
FIG. 2 is a perspective part cut-away view of the tail of the iron depicted in FIG. 1.

Referring to FIG. 2, the tail end of the iron shown in FIG. 1 includes a tongue 20 having a central cut-away region 21 in which is carried an earth pin 22 Electrical contacts are provided on either side of the cut-away region; as shown those for providing power to the heater element are designated 23 and those for providing connection to the temperature sensor are designated 24. The contacts 23 are slightly higher than contacts 24, considered in relation to the plane of the tongue.

Figure 3:
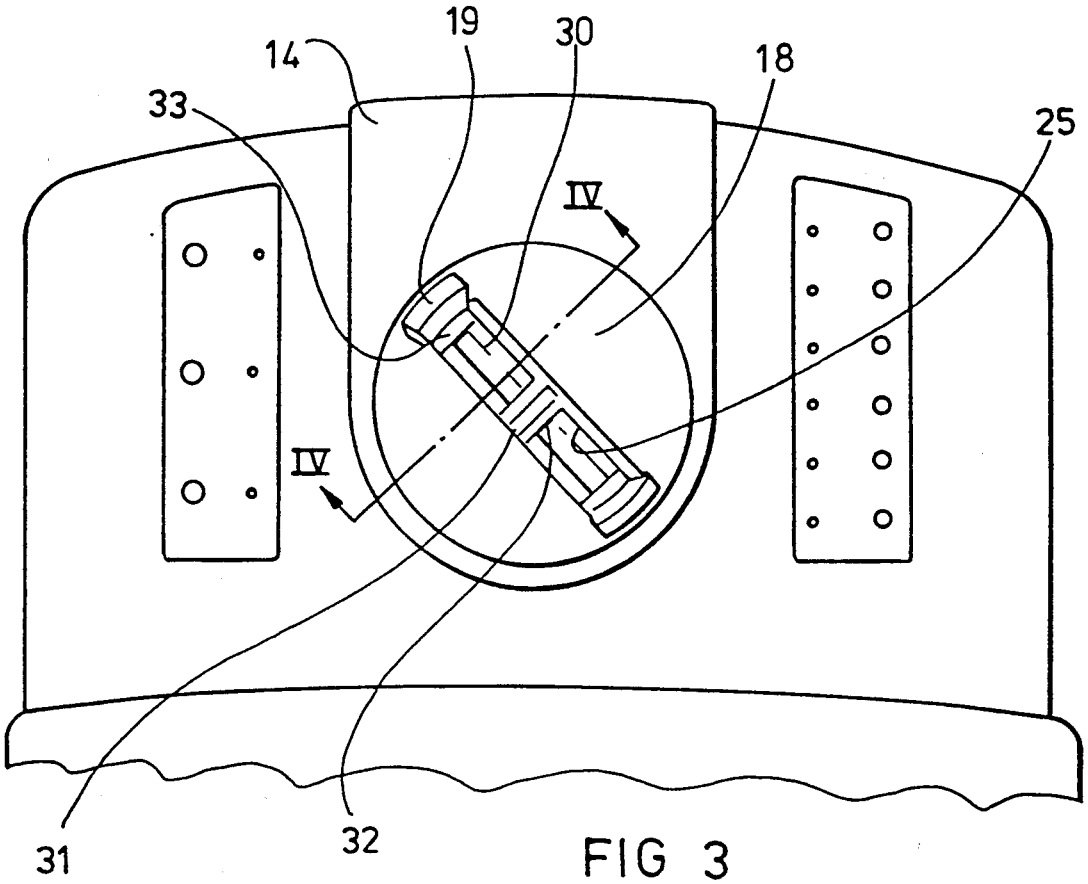
FIG. 3 is a plan view, partly cut away, of the parking dock depicted in FIG. 1.
Figure 4:
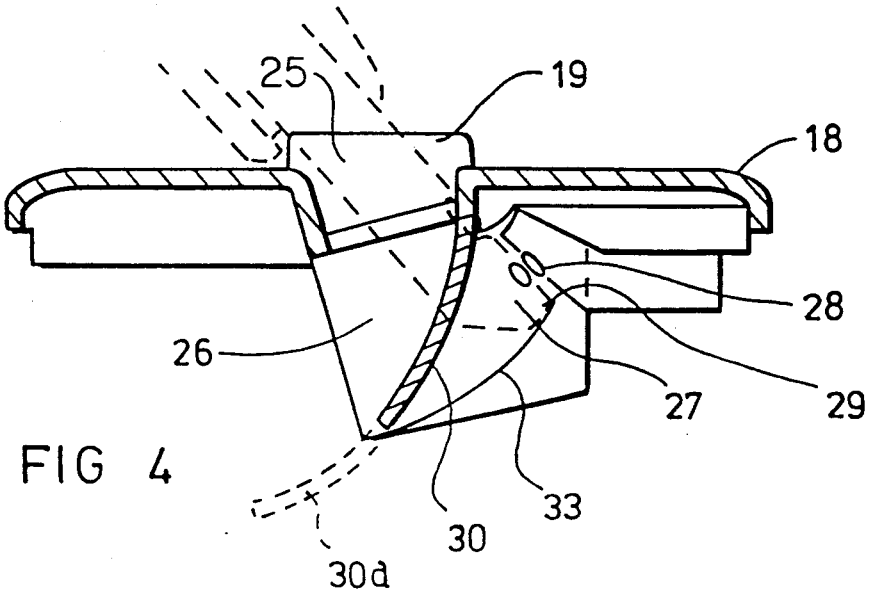
FIG. 4 is a section view along the line IV—IV of FIG. 3, also showing in dashed outline the tail of an iron in the rest position.

Referring to FIGS. 3 and 4, the turntable 18 of the support platform 14 is formed with a diametrical slot 25 which defines the mouth of a recess 26 which includes an undercut region 27. Electrical contacts 28 are provided in the undercut region, resiliently mounted at an angle to the horizontal on support plate 29. The contacts are concealed from view and from touch through the slot 25 by shutters 30 which are slidingly downwardly displaceable in arcuate channels (not shown) against a spring bias, to the position shown in dashed outline at 30*a*. The opening and closing of the shutters is controlled by an arm 31 centrally mounted in the slot 25 within an open-topped housing 32 which effectively divides the slot into two halves. The lower regions of the slot are formed at each end with arcuate shoulders 33. The arm 31 is electrically connected to the earth conductor of the power cable (not shown) attached to the support platform.

In use, the iron is held approximately vertically with the tail pointing downwards and the tail is offered to the slot 25 so that the earth pin 22 enters the housing 32 and engages the arm 31, thereby starting to displace the shutters 30. When the tongue 20 is at the position where it effectively blocks the mouth of the recess, the shutters are sufficiently open to permit the tongue to enter the recess until the lower corners of the tongue engage the shoulders 33. The iron is then allowed to fall forwardly allowing the tongue to perform a rearward arcuate movement, within the recess, guided by the shoulders 33, until the electrical contacts on the tongue engage the fixed contacts 28, the relative spacing of the contacts ensuring that the power contacts 23 are in engagement with their corresponding contacts 28 before the temperature sensor contacts 24. In FIG. 4, the tail of the iron is shown in dashed outline in the rest position with the contacts engaged. In this Figure, the shutters 30 are shown in the closed position, although in practice, with the iron so located, the shutters would be at the position indicated 30*a*.

Figure 5:
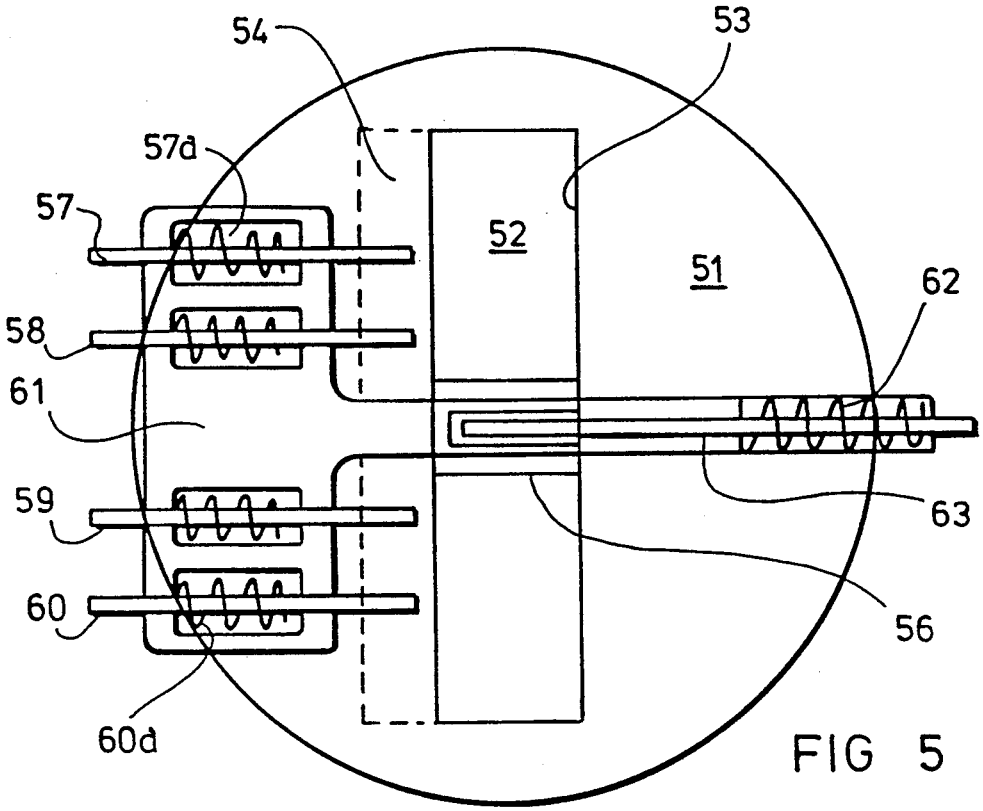
FIG. 5 is a fragmentary plan view of another parking dock arrangement.
Figure 6:
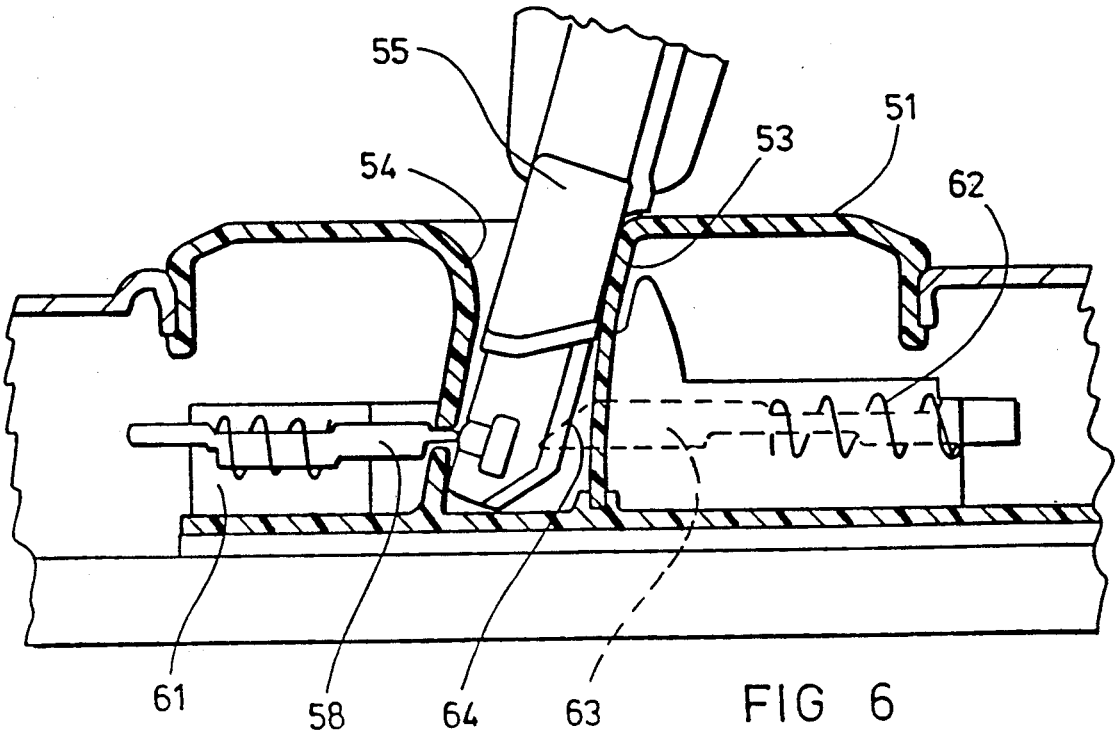
FIG. 6 is a sectional view through the arrangement of FIG. 5, also showing the tail of an iron in the rest position.

An alternative arrangement is shown in FIGS. 5 and 6. A turntable housing 51 as part of an ironing board parking dock has a slot 52 formed therein defining the mouth of a recess having sloping front and rear walls 53 and 54 respectively, rear wall 54 having a greater slope and forming an undercut region for receiving the tail 55 of an iron when interengaged in the rest position, as shown in FIG. 6. The slot includes a central open-topped housing 56.

Electrical contacts 57–60 (57 and 60 being for power and 58 and 59 for the temperature sensor) within the parking dock are carried on a T plate 61 which is slidably mounted and biassed by spring 62 to the left, as shown in the drawings. The contacts are aligned with apertures formed in wall 54 Under biassing pressure, the contacts are fully retracted behind wall 54. The leg of the T plate 61 carries a longitudinal operating arm 63 with a sloping end 64. This end is below the slit defined by the open-topped housing 56.

On offering the tail of the iron to the slot 52, the earth pin enters the slit defined by the open-topped housing 56 and displaces the operating arm 63 to the right, thereby bringing the contacts 57–60 forward against the bias and into contact, through the apertures in wall 54, with the electrical contacts on the iron. The contacts 57–60 are themselves individually displaceable against a bias, relative to their mountings, by springs 57*a*–60*a*, to provide substantially the same pressure between each respective pair of contacts.

Figure 7:
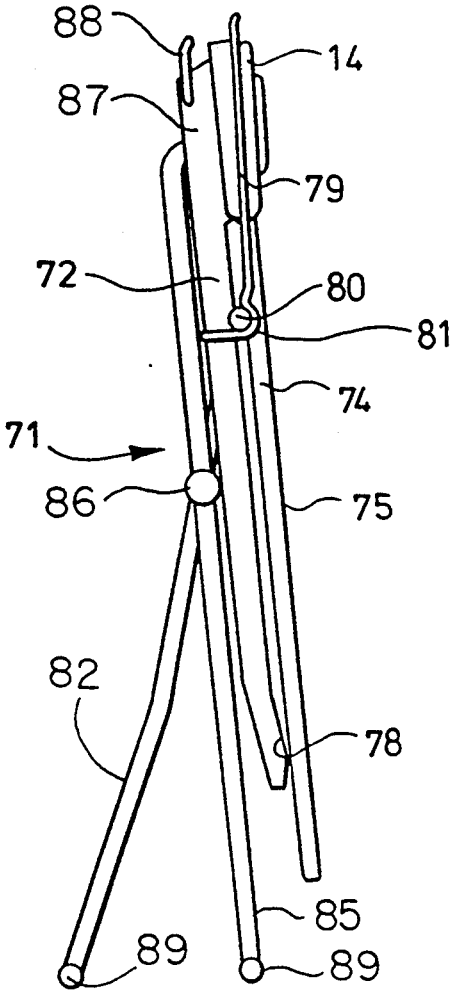
FIG. 7 is a side elevation showing an ironing board according to the invention in the trousers press mode with the pressing surfaces closed.
Figure 8:
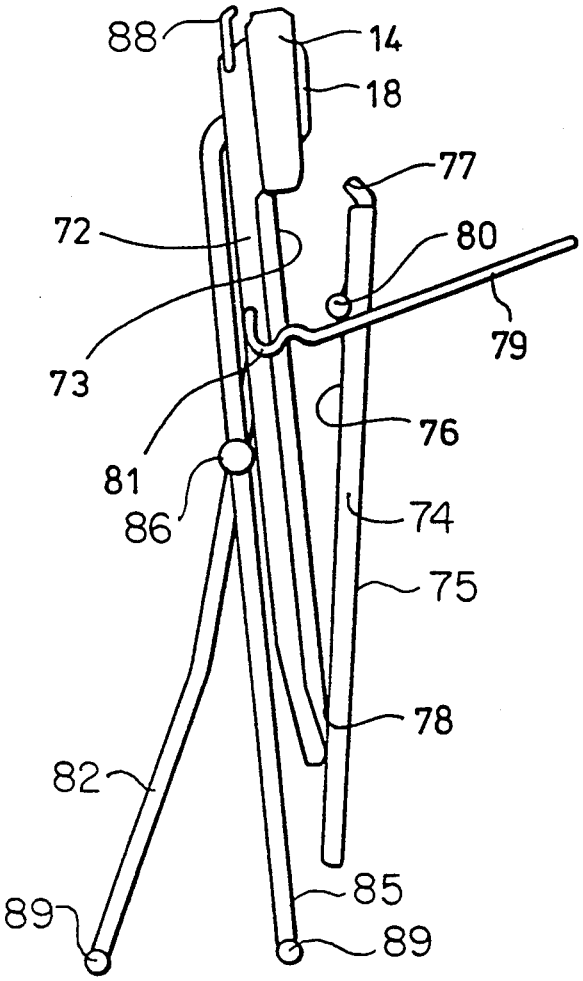
FIG. 8 is a side elevation of the board of FIG. 7 with the pressing surfaces open.
Figure 9:
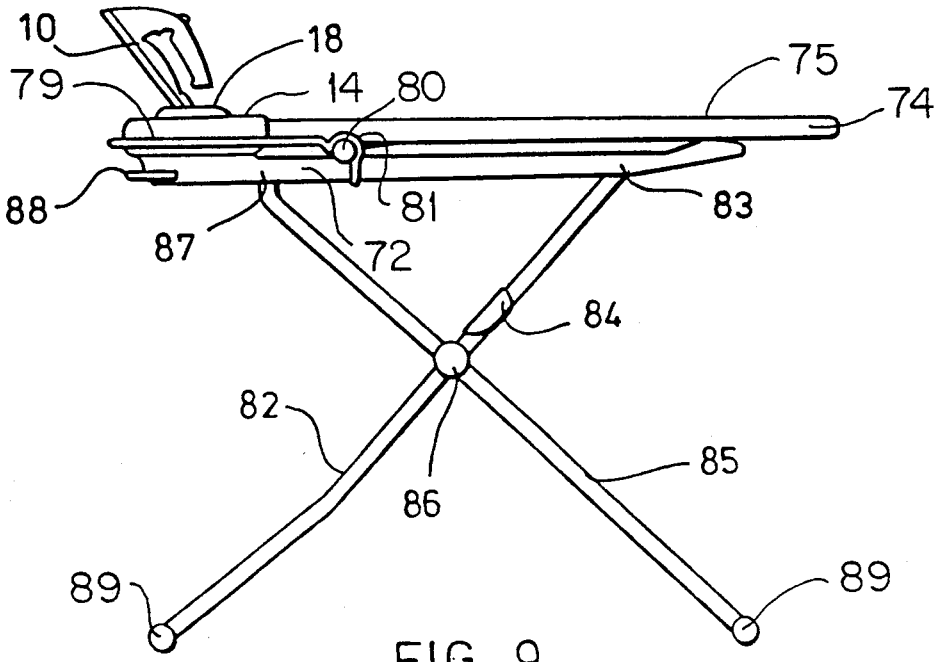
FIG. 9 is a side elevation of the board of FIGS. 7 and 8 in the normal ironing position.

Referring now to FIGS. 7, 8 and 9, an ironing board 71 consists of a lower plate assembly 72 having an upper pressing surface 73, and an upper plate assembly 74 the top surface 75 of which constitutes an ironing surface and the lower surface 76 of which constitutes a pressing surface which cooperates with surface 73 to form a trousers press, cooperable grippers being provided at the opening ends (one only being illustrated at 77). A support platform 14 for a cordless iron is provided at the upper end of the board (in the position shown in FIGS. 7 and 8) and the plate assemblies are hinged together at their lower ends at 78 by means of a displaceable hinge, in which the hinge pivot may be mounted on the upper plate assembly to be resiliently displaceable away from the lower plate assembly, for example by means of a spring steel mounting bracket attached to the lower plate assembly (see FIG. 10), to accommodate trousers, or other items to be pressed, of different thickness while maintaining even pressure along the board between the pressing surfaces. Movement of the plate assemblies is controlled by a lever 79 which is hingeably mounted on the rear of lower plate assembly 72. The arms of the lever are in engagement with rollers 80 mounted on the sides of the upper plate assembly 74, so that pivoting the lever 59 forwardly permits the rollers to roll along the arms and the upper plate assembly to swing open to the position shown in FIG. 8, while pivoting the lever upwardly causes the upper plate assembly to close to the position shown in FIG. 7. The ends of the arms at 81 are deformed to provide a notch to accommodate the rollers and retain the plate assemblies in the closed position against unintentional opening.

As shown in FIGS. 7 and 8, the supporting legs of the ironing board are open to an intermediate position in which the board is free-standing with the plate assemblies substantially vertical. The board is illustrated in FIG. 9 with the legs open to permit the board to be used for ironing. The leg 82 is hingeably connected to the underside of the lower plate assembly at 83 and is lockably jointed at a knee joint 84 for placing in a storage position (not shown) or for use in the trousers press mode; the leg 85 is pivotally attached to leg 82 at 86 and pivotally and slidably to the underside of the lower plate assembly at 87. The upper ends of the legs are relatively slidable towards and away from each other for the purpose of height adjustment, controlled by lever 88 which releases the legs or locks them at a desired height position. The lower ends of the legs terminate in ground-engaging pads 89 at least one of which may comprise a roller, for facilitating height adjustment.

By "plate assembly" is meant to include body or chassis components, heater elements, electrical connections thereto, padding, surface covering material, grippers for trousers, and the like, as required.

In FIG. 9, a cordless iron 10 is shown in the rest position on the support platform turntable 18.

Figure 10:
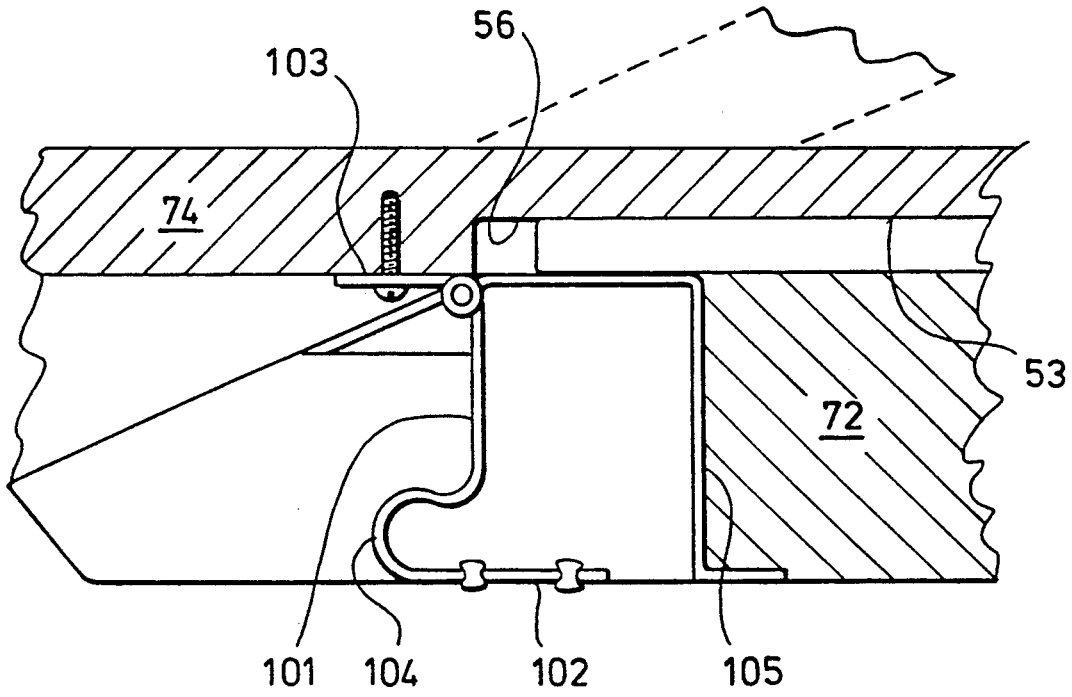
FIG. 10 is a detail of the expanding hinge of the board of FIGS. 7 to 9.

FIG. 10 illustrates an expanding hinge for use at position 78 in FIG. 7. The hinge consists of a spring steel bracket 101 attached to the lower plate assembly at 102 and to the upper plate assembly at 103. The upper and lower plate assemblies 74 and 72 are shown closed, but the open position for insertion of a garment to be pressed is shown in dashed outline and it will be understood that the thickness of the garment in the nip of the pressing surfaces is accommodated by the flexion of the bracket by virtue of the U bend formed therein at 104, in that the distance between the mounting points 102 and 103 can be expanded. The end of the lower plate pressing surface is supported with a degree of resilience by spring steel bracket 105.

Figure 11:
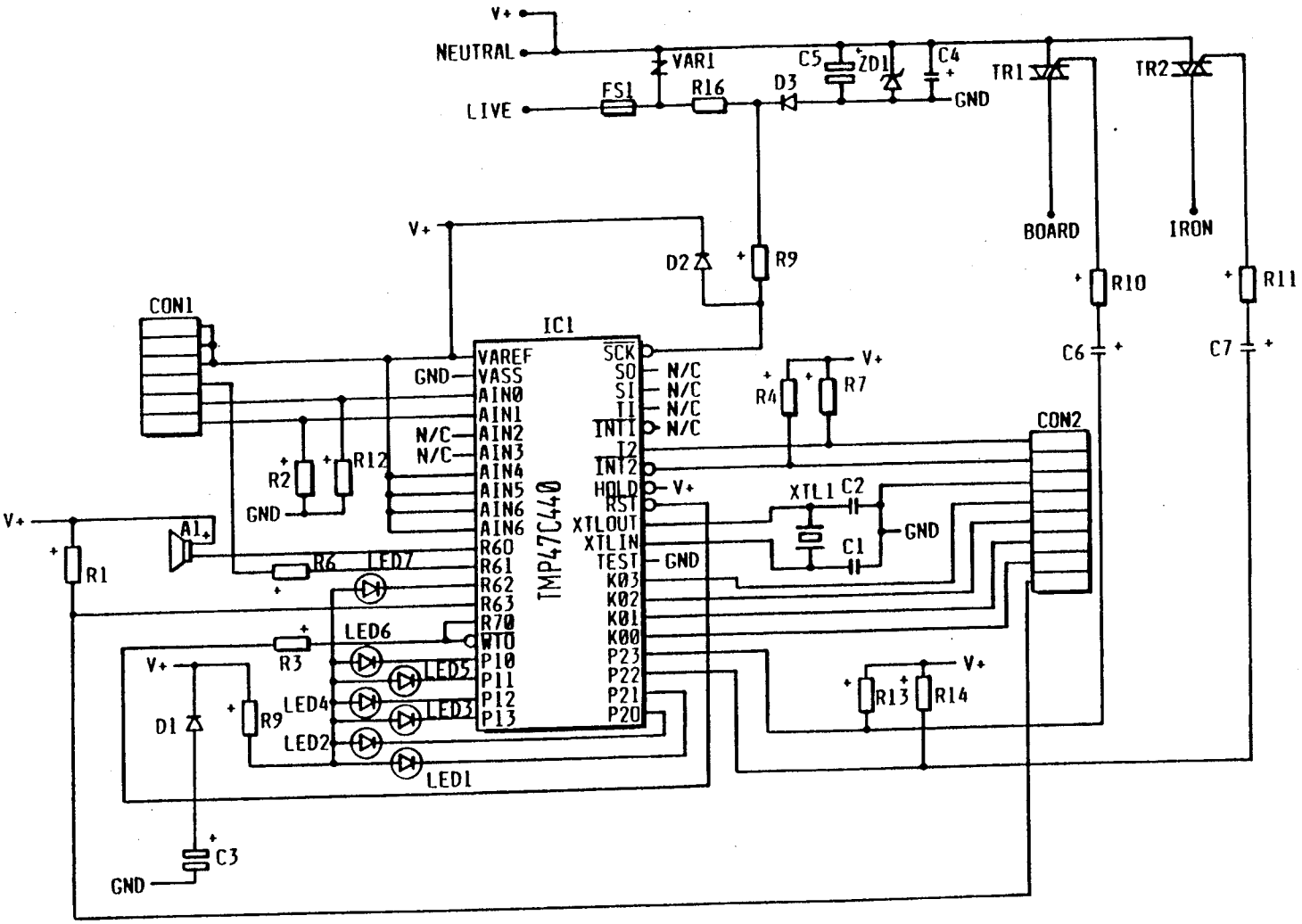
FIG. 11 is a circuit diagram of an electronic circuit for controlling the temperature of an iron and an ironing board.

FIG. 11 illustrates a control circuit for controlling the temperature of an iron and an ironing board from a single setting on a control panel.

Figure 12:
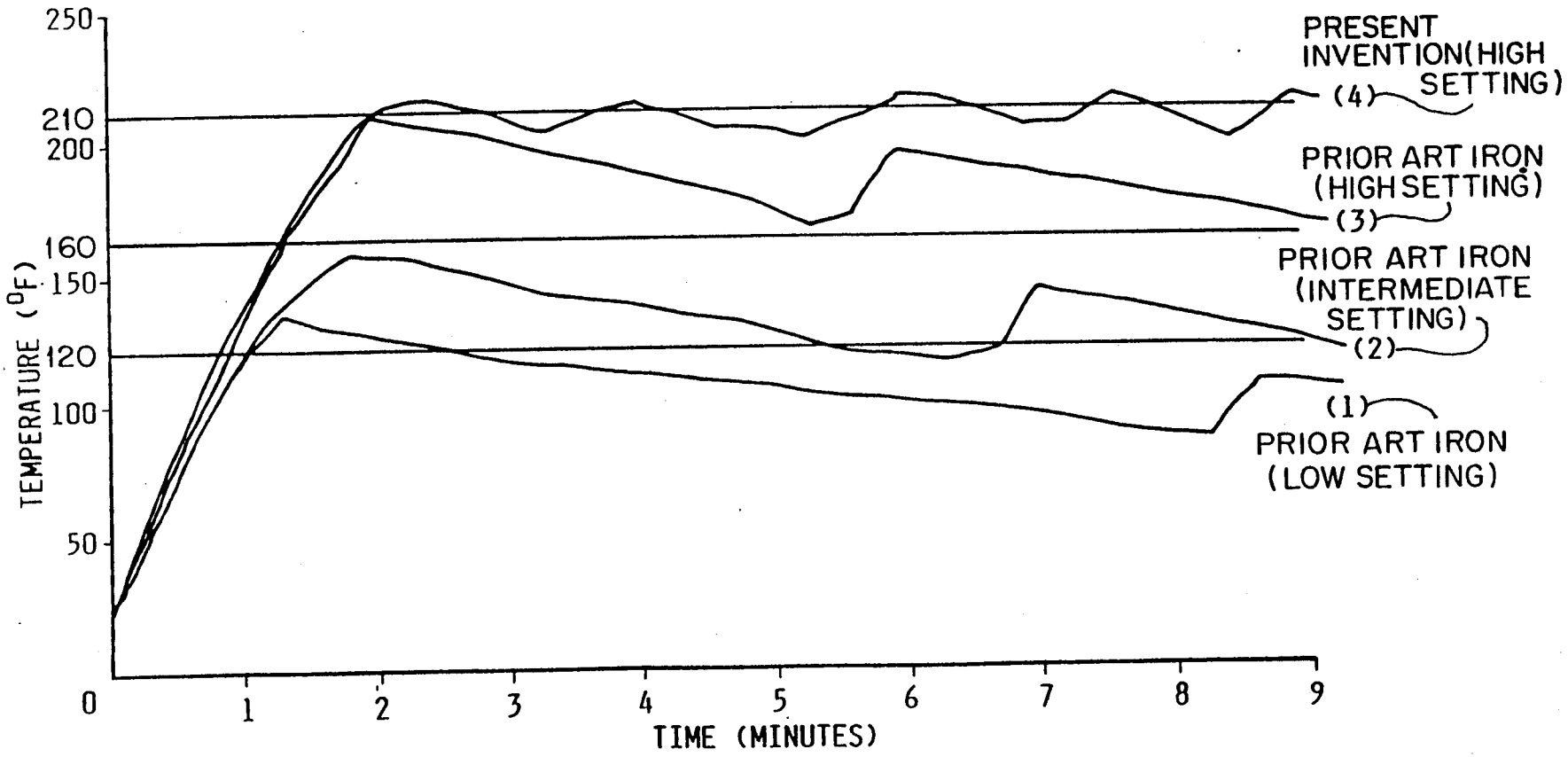
FIG. 12 is a graph showing the performance of the electronic control circuitry.

Referring now to FIG. 12, the performance of a cordless iron fitted with control circuitry as hereinbefore described is compared with a commercially-available cordless iron controlled by a traditional thermostat. In the graph, the temperatures of 120° C., 160° C. and 210° C. are recommended by the Home Laundry Consultative Council as being suitable for pressing for example nylons; other man-made textile fabrics and mixtures; and linens and cottons respectively. The prior art iron was tested at all three settings and is seen to fluctuate widely below the set temperatures, (curves 1, 2 and 3 respectively), whereas the inventive iron, which was tested only at the highest setting, was controlled to within a narrow temperature band on either side of the set temperature (curve 4).

I claim:

1. Pressing apparatus comprising a cordless iron having an electrically-energised heater element, and a control module including a support for the iron, cooperable electrical connection means on said iron and said support whereby the iron is in electrical connection with a source of electrical power when the iron is located on the support, the iron having a temperature sensor in thermal contact with the sole plate thereof and the control module having control circuitry including temperature selection means for controlling the supply of electrical power to the heater element according to the perceived temperature of the sole plate as sensed by said temperature sensor in relation to the selected temperature, in which the iron and the support include cooperative interengagement means whereby the iron is locatable on or removable from its position of electrical connection via a disconnection position, the iron describing a forward pivotal movement with respect to the support between the said disconnection position and a connection position wherein said cooperable electrical connection means on said iron and support are in electrical engagement.

2. Pressing apparatus according to claim 1, in which the cooperative interengagement means comprise a tongue formed at the tail end of the iron and a recess formed in the support, the recess having a mouth and including an undercut region to accommodate the tongue as the iron pivots forwardly.

3. Pressing apparatus according to claim 2, in which the recess has side walls which receive the tongue with marginal clearance and extend upwardly as raised upstanding formations to enhance the lateral stability of the iron when in the connection position.

4. Pressing apparatus according to claim 2, in which said cooperable electrical connection means on said iron and said support comprise electrical contacts provided on the upper surface of the tongue and corresponding contacts are mounted within the recess for mutual engagement when the iron is in the connection position.

5. Pressing apparatus according to claim 2 in which the recess has side walls which extend upwardly as raised, upstanding formations to enhance the lateral stability of the iron when in the connection position.

6. Pressing apparatus according to claim 1, including electrical contacts on the support which can be energized; and isolation means to prevent access to energized said electrical contacts in the support when the iron is removed therefrom.

7. Pressing apparatus according to claim 6, wherein said isolation means mechanically prevents access to said electrical contacts.

8. Pressing apparatus according to claim 6, wherein said isolation means electrically isolates said electrical contacts to prevent access to an energized electrical contact when the iron is removed from said support.

9. Pressing apparatus according to claim 1, further including electrical contacts for the iron and the support; and means to prevent between said contacts on moving the iron between the connection and disconnection positions.

10. Pressing apparatus according to claim 1 in which the control module is incorporated in an ironing board.

11. Pressing applications according to claim 10 wherein the ironing board has a heater element; and wherein said iron and board heater element are controlled by said control circuitry.

12. Pressing apparatus according to claim 11, in which the ironing surface of the board comprises a plate which cooperates with an underlying plate to form a trousers press, the underlying plate being connected to a support system for maintaining the plates above ground level either substantially horizontally disposed for use in the ironing mode or substantially vertically disposed for use in the trousers press mode.

13. Pressing apparatus according to claim 12, in which the plates are hingeably connected together by a displaceable hinge which permits the pressing surfaces to move apart in the trousers press mode while remaining substantially mutually parallel, to accommodate different thicknesses of items being pressed while maintaining even overall pressure thereon.

14. Pressing apparatus according to claim 12, in which the underlying plate has said heater element provided in the ironing board controlled by the same control circuitry as and to independently-programmable temperatures relative to the heater element in the ironing plate.

* * * * *